US012503753B2

(12) United States Patent
Krizan et al.

(10) Patent No.: US 12,503,753 B2
(45) Date of Patent: Dec. 23, 2025

(54) MEDIUM MANGANESE COLD-ROLLED STEEL INTERMEDIATE PRODUCT HAVING A REDUCED CARBON CONTENT, AND METHOD FOR PROVIDING SUCH A STEEL INTERMEDIATE PRODUCT

(71) Applicant: VOESTALPINE STAHL GMBH, Linz (AT)

(72) Inventors: Daniel Krizan, Linz (AT); Katharina Steindeder, Linz (AT); Reinhold Schneider, Wels (AT)

(73) Assignee: VOESTALPINE STAHL GMBH, Linz (AT)

( * ) Notice: Subject to any disclaimer, the term of this patent is extended or adjusted under 35 U.S.C. 154(b) by 1088 days.

(21) Appl. No.: 17/258,398

(22) PCT Filed: Jul. 4, 2019

(86) PCT No.: PCT/EP2019/067977
§ 371 (c)(1),
(2) Date: Jun. 30, 2021

(87) PCT Pub. No.: WO2020/011638
PCT Pub. Date: Jan. 16, 2020

(65) Prior Publication Data

US 2022/0002847 A1 Jan. 6, 2022

(30) Foreign Application Priority Data

Jul. 13, 2018 (EP) ..... 18183501

(51) Int. Cl.

| | |
|---|---|
| ***C22C 38/38*** | (2006.01) |
| ***C21D 1/26*** | (2006.01) |
| ***C21D 9/52*** | (2006.01) |
| ***C22C 38/02*** | (2006.01) |
| ***C22C 38/04*** | (2006.01) |
| ***C22C 38/06*** | (2006.01) |
| *C21D 9/46* | (2006.01) |

(52) U.S. Cl.
CPC ..... *C22C 38/38* (2013.01); *C21D 1/26* (2013.01); *C21D 9/52* (2013.01); *C22C 38/02* (2013.01); *C22C 38/04* (2013.01); *C22C 38/06* (2013.01); *C21D 9/46* (2013.01); *C21D 2211/001* (2013.01); *C21D 2211/003* (2013.01); *C21D 2211/005* (2013.01); *C21D 2211/008* (2013.01)

(58) Field of Classification Search
CPC ..... C22C 38/38
See application file for complete search history.

(56) References Cited

U.S. PATENT DOCUMENTS

2014/0338800 A1* 11/2014 Leinonen ..... C21D 8/0247 148/567
2019/0071748 A1* 3/2019 Füreder-Kitzmüller ..... C21D 8/0205

FOREIGN PATENT DOCUMENTS

| | | | | |
|---|---|---|---|---|
| CN | 107858586 | A | 3/2018 | |
| EP | 2703512 | A1 | 3/2014 | |
| EP | 3222734 | A1 | 9/2017 | |
| WO | WO-2017162450 | A1 * | 9/2017 | ..... C21D 1/26 |

OTHER PUBLICATIONS

Gibbs P Jet al. "Austenite Stability Effects on Tensile Behavior of Manganese-Euriched-Austenite Transformation-Induced Plasticity Steel" Metallurgical and Materials Transactions A, Springer-Verlag, New York, vol. 42, No. 12, Apr. 27, 2011 (Apr. 27, 2011), pp. 3691-3702 DOI: 10.1007/SII661-0II-0687-Y ISSN: 1543-1940, XP035069998; https://link.springer.com/article/10.1007/s11661-011-0687-y , downloaded Jan. 5, 2021.

Zou Yet al. "High strength-toughness combination of a low-carbon medium-manganese steel plate with laminated microstructure and retained austenite" Materials Science and Engineering: A, vol. 707, Sep. 18, 2017 (Sep. 18, 2017), pp. 270-279 DOI: 10.1016/J.MSEA.2017.09.059 ISSN: 0921-5093, XP085234481; https://www.sciencedirect.com/science/article/abs/pii/S0921509317312194?via%3Dihub , downloadedd Jan. 5, 2021.

Lee Y Ket al. "Current opinion in medium manganese steel" Materials Science and Technology, Taylor & Francis, GB, vol. 31, No. 7, Jan. 1, 2015 (Jan. 1, 2015), pp. 843-856, [retrieved on Nov. 26, 2014] DOI: 10.1179/I 743284714Y.0000000722 ISSN: 0267-0836, XP002757591; https://www.tandfonline.com/doi/full/10.1179/1743284714Y.0000000722 , downloadded Jan. 5, 2021.

International Search Report for corresponding PCT application No. PCT /EP2019/067977, mailed Sep. 20, 2019.

(Continued)

*Primary Examiner* — Jophy S. Koshy
(74) *Attorney, Agent, or Firm* — Notaro, Michalos & Zaccaria P.C.

(57) ABSTRACT

A medium manganese cold-rolled steel intermediate product having an improved fts value is disclosed, the alloy having a carbon fraction within the range 0.003 wt %<C<0.12 wt %, a manganese fraction (Mn) within the range 3.5 wt %<Mn<12 wt %, a silicon fraction (Si) and/or an aluminium fraction (Al) as alloy fractions, where Si wt %+Al wt %<1, optionally further alloy fractions, optional microalloy fractions, in particular a titanium fraction (Ti) and/or a niobium fraction (Nb) and/or vanadium fraction (V), and the remainder of the alloy has iron (Fe) and unavoidable impurities of a melt. A method is also disclosed having the following step that is carried out after the cold-rolling step performing an intercritical box annealing process at a maximum annealing temperature of 684Â° C.–(517Â° C.*the carbon fraction in wt %).

9 Claims, 5 Drawing Sheets

(56) References Cited

OTHER PUBLICATIONS

International Preliminary Report on Patentability and Written Opinion for corresponding PCT application No. PCT/EP2019/067977, issued Jan. 19, 2021.
P. Larour et al., "Reduction of cross section area at fracture in tensile test: measurement and applications for flat sheet steels", IDDRG 2017.

* cited by examiner

MEDIUM MANGANESE COLD-ROLLED STEEL INTERMEDIATE PRODUCT HAVING A REDUCED CARBON CONTENT, AND METHOD FOR PROVIDING SUCH A STEEL INTERMEDIATE PRODUCT

The present invention relates to a method for providing a medium-manganese cold strip steel intermediate product with reduced carbon content and medium-manganese cold strip steel intermediate products with reduced carbon content.

Both the composition, respectively alloy as well as the heat treatment in the manufacturing process do have a significant influence on the properties of steel products.

A major component of today's steel-alloys is manganese (Mn). The content of manganese in weight % is often in the range between 3 and 12%. These steels are therefore so-called median-manganese steels, which are also referred to as a medium-manganese steels.

Medium manganese steels are characterized, for example, by a structure that consists of a ferritic matrix and retained austenite. The content of ferrite in medium manganese steels usually has a maximum at 90 volume %. The austenite content, however, is usually in the range of about 30 vol. %.

Ferrite (also alpha- or α-mixed crystal) is the metallurgic designation of a body-centered cubic iron mixed crystal, in the lattice of which carbon (i.e., in intermediate positions of the lattice) is dissolved interstitially. A pure ferritic structure possesses a low strength but a high ductility. The strength can be improved by adding carbon, whereby this is at the expense of the ductility.

An austenite structure (also called gamma- or γ-mixed crystal) is a face-centered cubic iron mixed crystal which can form in a steel product. This is a high-temperature phase which can be stabilized at room temperature by the addition of alloying elements, such as, for example, carbon, manganese, nickel, etc.

Over the years there have been several development stages or advancements in the field of medium manganese steels.

In FIG. 1 a diagram is shown in which the elongation after fracture $A_{80}$ in percent over the tensile strength $R_m$ in MPa is plotted. The diagram in FIG. 1 gives an overview of the strength classes of currently used steel materials. In general, the following statement applies: the higher the tensile strength of a steel alloy, the lower the elongation after fracture of this alloy. In simple terms it can be stated that the elongation after fracture decreases with increasing tensile strength and vice versa. An optimal compromise between elongation after fracture and tensile strength must therefore be found for each application. Statements about the relationship between the strength and the deformability of various steel materials can be extracted from FIG. 1.

In the area which is designated by the reference number 1, the medium-manganese steels mentioned above are summarized schematically. The area denoted by reference number 1 comprises medium manganese steels with an Mn content between 3 and 12 weight %.

The so-called TRIP steels are designated by the reference number 2 and the so-called TRIP bainitic ferrite (TBF) and the Quenching and Partitioning (Q&P) steels carry the reference number 3. TRIP stands in English for "Transformation Induced Plasticity".

In the automotive sector one is working with a whole range of different cold formable steel alloys which were each optimized for their respective application in the vehicle. Alloys with good energy absorption are used in interior and exterior panels, structural parts and bumpers. Alloys for the outer skin of a vehicle have a lower yield strength and tensile strength typically up to 600 MPa and a higher elongation after fracture. The steel alloys of structural components, for example, have a tensile strength in the range between 600 and 1200 MPa. For example, the TRIP steels are suitable for this (reference number 2 in FIG. 1).

In the meantime, there are medium-manganese steels, which belong to the 3rd generation of the Advanced High Strength Steels (AHSS). These steels show a good combination of strength and elongation. Newer steels of the 3rd generation achieve $R_m x A_{80}$ values of approx. 30,000 MPa % and are therefore suitable, for example, for the production of complex deep-drawn components such as those used in the automotive industry (reference number 1 in FIG. 1). The TBF and Q&P steels already mentioned are also counted as 3rd generation of higher-strength steels. These steel grades are suitable, for example, for use as steel barriers (e.g. for side impact protection against the intrusion of vehicle parts). They have a manganese content in the range between 1.5 and 3 wt. %.

On the process side, there are many different ways of making such powerful steels, inter alia, the temperature ranges which are specified, the heating and cooling rates and other aspects have a huge impact on the structure and hence on the quality and characteristics of the steel product.

There is a need to provide cold strip steel intermediate products, which have an improved deformability as compared to the known cold strip steel intermediate products. The deformability consists of a global and a local part. The global deformability primarily describes the behavior of the material during deep-drawing operations. The uniform elongation $A_g$, in English uniform elongation (UE), is suitable for describing the global deformability. The local deformability on the other hand, is a measure of the behavior of the material under multiaxial stress conditions, as for example occur in a hole expansion test. The fracture thickness strain in percent, abbreviated to fts, is a corresponding measure of the local deformability of steels. A detailed description of this characteristic can be found in P. Larour et al., "Reduction of cross section area at fracture in tensile test: measurement and applications for flat sheet steels", IDDRG 2017.

So far, a compromise had to be found mostly between the local and global deformability. DP steels (DP steel stands for Dual-phase steel) have significantly lower fts values than CP steels (CP-steel stands for complex-phase steel), as can be derived from the graph of FIG. 2. In contrast, they however have a better global deformability, characterized by the value of the UE in percentage. The more homogeneous microstructure of the complex-phase steels leads to excellent properties in terms of local deformability in comparison to DP steels, for example, and is represented in higher fts values.

There are several reasons for the different properties of DP steels and CP steels. One reason is the different hardness contrasts between the individual structural components of these materials. DP steels typically have a high hardness contrast of the structure compared to CP steels. The DP steels therefore show a high hardening rate and thus high elongation, i.e. high UE values. DP steels are not well locally deformable, but can be deepdrawn well. CP steels, on the other hand, harden less than DP steels and can therefore be locally deformed better.

Medium-manganese steels, at issue here, show because of their structure a similarly high hardness contrast as the DP steels, therefore, here a better global formability, i.e. higher UE values, are to be expected. The high hardness contrast in medium manganese steels results from the transformation of residual austenite into hard martensite during deformation. This leads to high hardness contrasts between the soft ferritic matrix and hard martensitic inclusions.

In particular, the object is to provide cold strip steel intermediate products which have a good combination of tensile strength and elongation after fracture and which at the same time show a good local deformability. It arises in particular the object to provide cold strip steel intermediate products which have a better combination of uniform elongation (expressed as UE values) and local deformability (expressed in fts values) as DP- and CP-steels.

A cold strip steel intermediate product is provided whose structure includes a low martensitic strength, the highest possible ferritic strength and possibly a homogeneous and slowly transforming austenite, because of the high stability.

A method for providing a medium-manganese cold strip steel intermediate product is claimed, the alloy of which comprises:

- a carbon content (C) in the range 0.003 wt. %≤C %≤0.12 wt. %,
- a manganese content (Mn) in the range 3.5 wt. %%≤Mn %≤12 wt. %,
- a silicon content (Si) and/or an aluminum content (Al) as alloy components, with Si wt. %+Al wt. %<1,
- optional further alloy components,
- optional micro-alloy components, in particular a titanium content (Ti) and/or a niobium content (Nb) and/or a vanadium content (V), and
- where the remainder of the alloy comprises iron (Fe) and unavoidable impurities in a melt, whereby the method comprises the step, which is carried out after a cold rolling step:

- performing an intercritical box annealing at a maximum annealing temperature of 684° C.−(517° C.*the carbon content in wt. %).

In at least part of the embodiments, the intercritical box annealing is selected as part of a one-step annealing process so that the cold strip steel intermediate product after this step has a microstructure with the following proportions:

- a residual austenite content in the range ≥10% and ≤60%, and preferably in the range ≥10% and ≤40%,
- an alpha-ferrite content in the range ≥20% and ≤90%, and preferably in the range of ≥50% and ≤80%, and
- a cementite content in the range ≥0% and ≤5%.

Preferably, in these embodiments for the intercritical box annealing method a maximum annealing temperature of 648° C.−(352° C.*the carbon content in wt. %) is specified.

In at least part of the embodiments, the intercritical box annealing method is selected as part of a two-step annealing process so that the cold strip steel intermediate product after this step has a microstructure with the following proportions:

- a martensite content in the range ≥0% and ≤20%, and preferably in the range ≥0% and ≤10%,
- a residual austenite content in the range ≥10% and ≤60%, and preferably in the range ≥10% and ≤40%,
- an alpha ferrite content in the range ≥20% and ≤90%, and preferably in the range ≥50% and ≤80% and
- a cementite content in the range ≥0% and ≤5%.

Preferably, in these embodiments, a fully austenitic annealing processes is carried out prior to the intercritical box annealing.

In at least some of the embodiments, an annealing temperature is specifically chosen which is dependent on the carbon content in wt. % and which is lower than the maximum annealing temperature in order to obtain a medium-manganese-cold-strip steel intermediate product that has an fts-value that is at least 40%. If a one-step annealing process is used, the maximum annealing temperature is defined by the formula 648° C.−(352° C.*the carbon content in wt. %). If a two-step annealing process is used, the maximum annealing temperature is defined by the formula 684° C.−(517° C.*the carbon content in wt. %).

In accordance with the invention a steel intermediate product having a good local and global good formability, preferably a cold strip steel intermediate product, is provided by a combination of a process- and an alloying-concept.

According to the invention, a cold strip steel intermediate product is provided that has a good $R_m$*$A_{so}$ combination, as with other medium-Mangan steels, and at the same time a good local deformability, i.e. high fts values.

Such cold strip steel intermediate products are provided by the inventive method in that the carbon content is lowered and the Ferrite morphology, respectively Austenite morphology are intentionally changed by a specially adapted annealing. Furthermore, a residual austenite with high stability is adjusted by lowering the intercritical annealing temperature which is applied during manufacturing in annealing the steel intermediate product.

Although one typically increases the carbon content, if an increased strength steel intermediate product is wanted, the invention relies on a significant reduction of the carbon content. By reducing the carbon content a lower martensitic strength is achieved, which corresponds to a reduction of the hardness contrast it in the structure.

Although typically relatively high silicon- and aluminum-contents are employed, the invention uses a significant reduction of the silicon- and aluminum-contents. The silicon- and aluminum-alloy proportions are limited by the formula Si wt. %+Al wt. %<1. Since the silicon- and aluminum-alloy proportions are limited here, the annealing processes can be carried out with modified parameters.

In at least part of the embodiments one specially uses an alloy composition which comprises only a low sulfur content. The sulfur content is preferably less than 60 ppm. By reducing the sulfur content, fewer sulfides are formed and the fts values can improve, depending on the design of the annealing process.

Based on thermodynamic models, the optimum annealing temperature can be calculated for a steel alloy, which is chosen to achieve the maximum residual austenite content and thus an excellent combination of $R_m x A_{80}$.

The method of the invention is based on a specially optimized medium-manganese alloy, and is in addition based on a lower annealing temperature, since due to the lower temperature during the annealing better deforming properties are achieved. By lowering the intercritical annealing temperature, the medium-manganese alloy of the invention loses some of its tensile strength and uniform elongation, but simultaneously a higher residual austenite stability is reached, which leads to a higher global deformability (i.e. higher fts values).

In order to alter the Ferrite morphology, respectively the Austenite morphology specifically, in at least some of the embodiments of a fully austenitic annealing is applied, followed by an intercritical annealing. This results in higher fts values for the correspondingly annealed intermediate steel products.

Preferably the invention is used to provide cold strip steel intermediate products in the form of cold rolled flat products (for example, coils).

DRAWINGS

Exemplary embodiments of the invention are described in more detail below with reference to the drawings.

Figure 6:
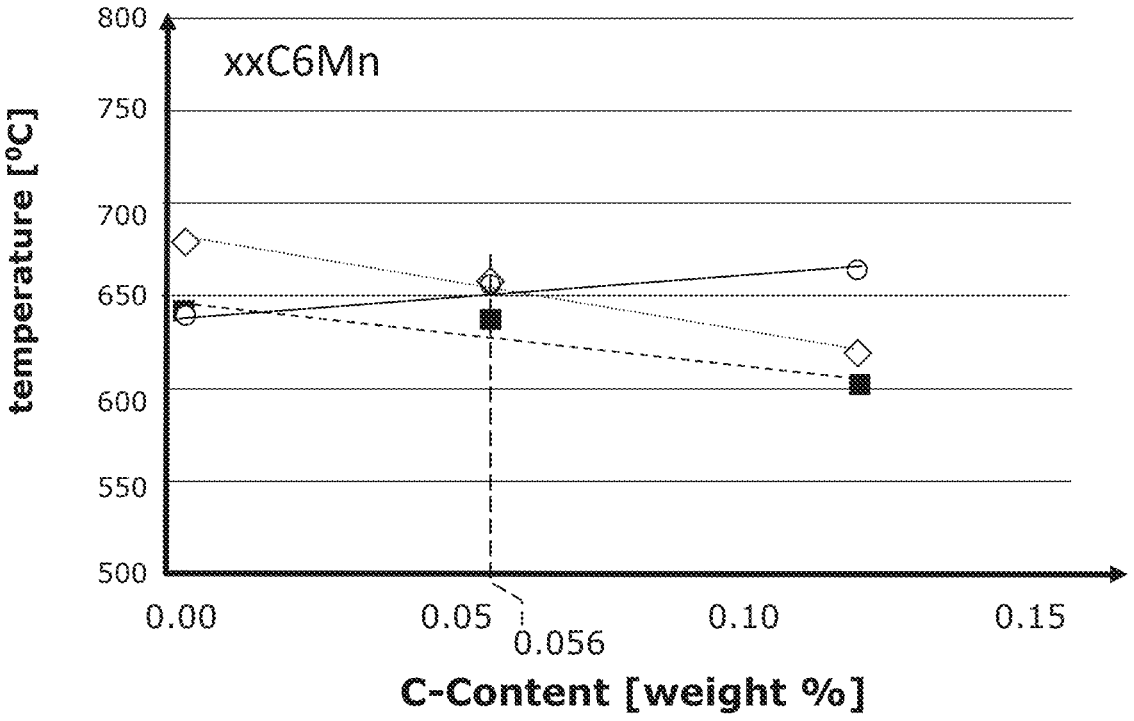
Figure 7:
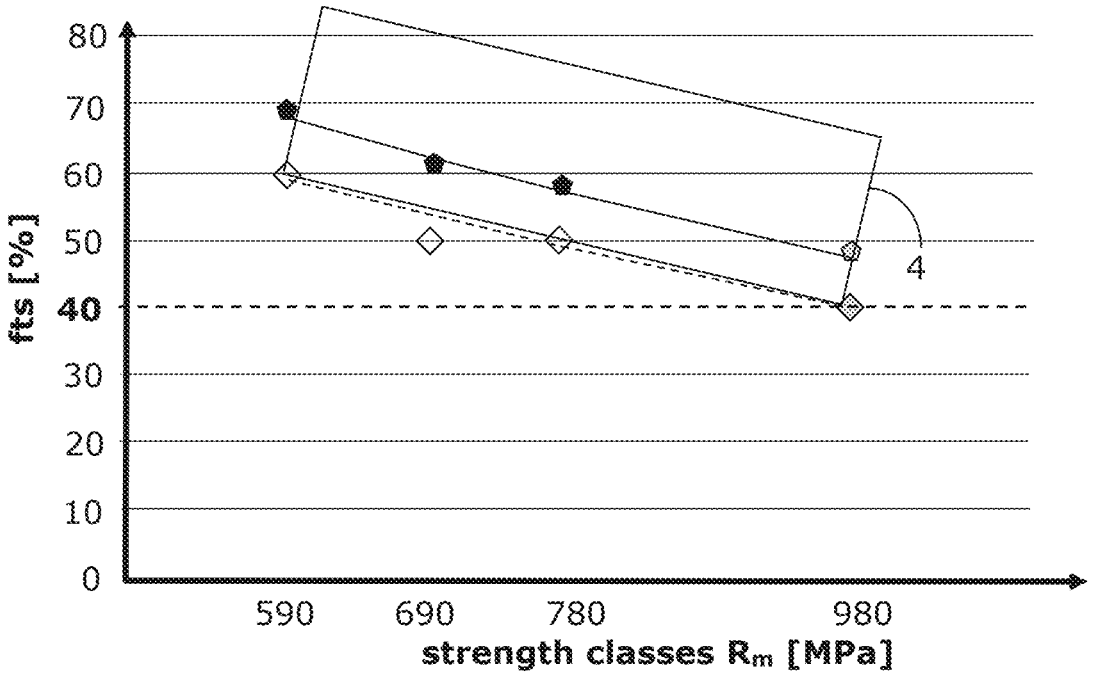
Figure 8:
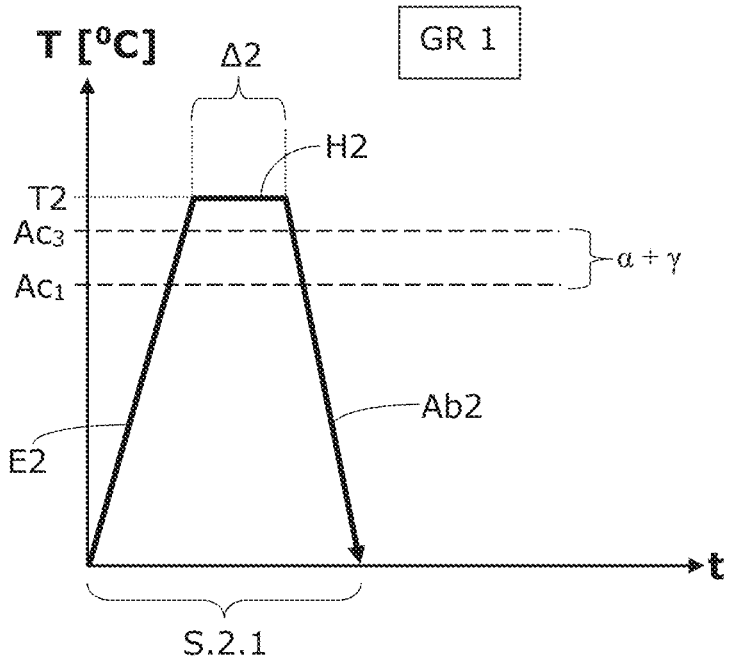
Figure 9:
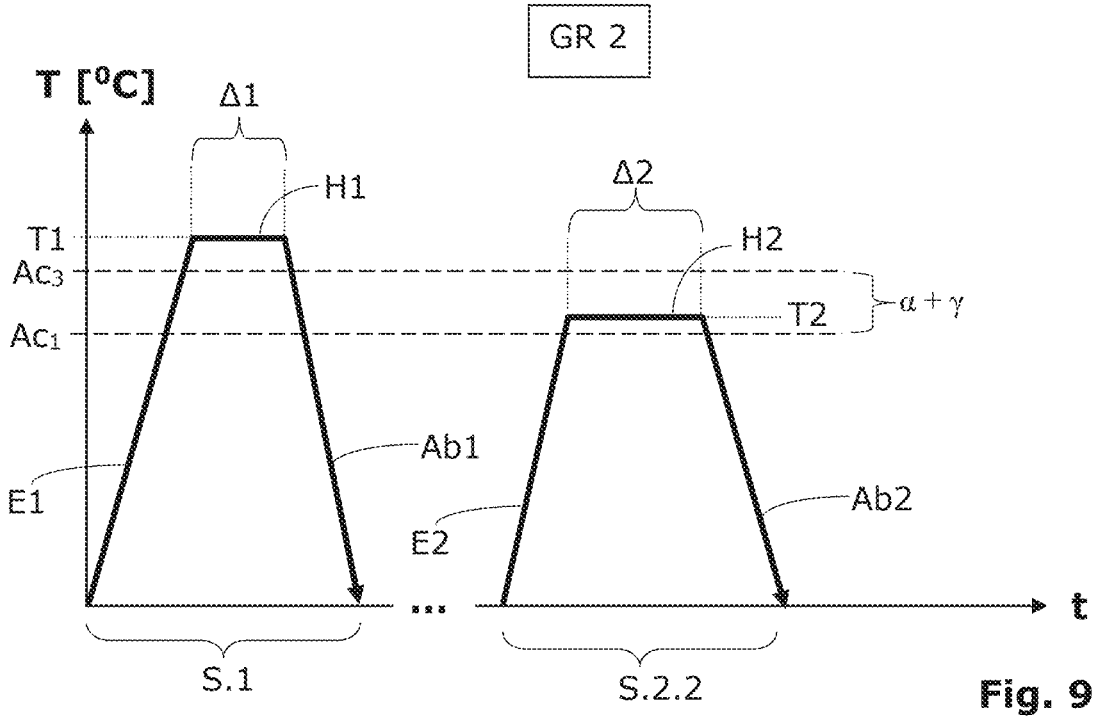

FIG. 6 shows a highly schematic diagram in which the annealing temperature was plotted against the carbon content for various medium-manganese-steel alloys of the invention, specifically the experimentally determined annealing temperatures $T_{RAmax}$ when reaching the maximum amount of retained austenite as a function of the carbon content are shown; furthermore in the diagram, the maximum annealing temperatures $T_{ANmax}$ for single- and double-annealing can be found, for achieving an increased fts value;

FIG. 7 shows a highly schematic diagram, in which the fracture thickness strain (fts) in percentage over different strength classes $R_m$ in MPa was plotted;

FIG. 8 shows a schematic representation of an exemplary temperature-time diagram for the single step temperature treatment (GR 1) of a steel (intermediate) product of the invention;

FIG. 9 shows a schematic representation of an exemplary temperature-time diagram for the two-step temperature treatment (GR 2) of a steel (intermediate) product of the invention.

DETAILED DESCRIPTION

The cold strip steel intermediate products of the invention are produced by lowering the carbon content of the initial alloy. It has been shown that the fts value can be increased by significantly reducing the carbon content. By reducing the carbon content, the hardness contrast in the structure is reduced. This relationship has been confirmed and quantified on the basis of studies, which have shown that there are limits for the carbon content. In the context of the invention, only alloys are thus used whose carbon content is less than 0.12 wt. %.

The fts value is to be determined on a tested, non-notched steel flat tensile specimen. The initial thickness of the intermediate steel product $d_0$ and the thickness at the fracture surface $d_1$ must be determined. The fts value is calculated as follows $(d_0-d_1)/d_0*100$ in %.

Figure 3:
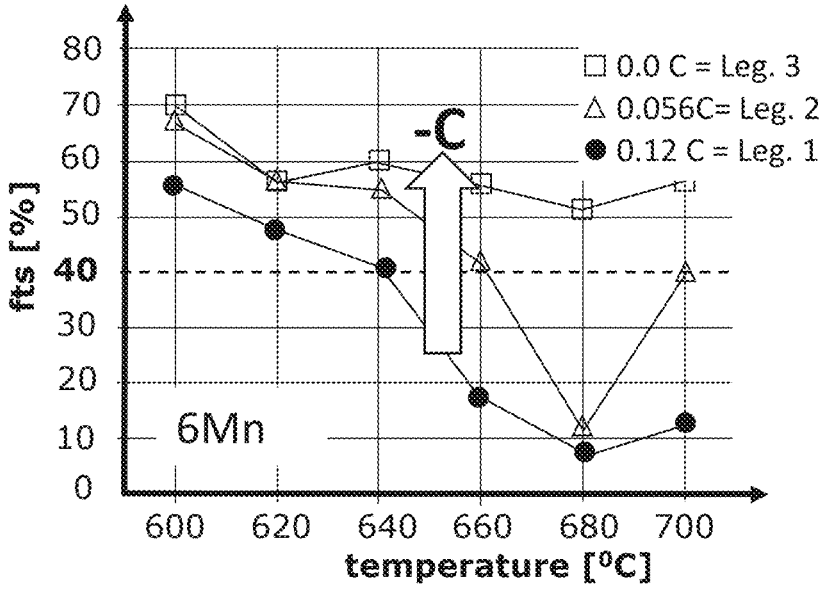
FIG. 3 shows a highly schematic diagram in which, for three medium manganese alloys with different carbon contents of the invention, the fracture thickness strain (fts) is plotted as a percentage over the temperature that was used during the annealing.

FIG. 3 shows a diagram in which the fts values of multiple steel alloys of the invention are plotted versus the annealing temperature. Specifically, several samples were examined here that comprise a carbon content (C) in the range from 0 wt. % to 0.12 wt. % and a manganese content (Mn) of 6 wt. %, wherein the alloy contains silicon (Si) and aluminum (Al) according to the following formula Si wt. %+Al wt. %<1 and the rest of the alloy comprises iron (Fe) and unavoidable impurities of the respective melt.

Different correlations can be derived from FIG. 3, as follows. If, for example, one anneals alloy 1 (abbreviated to Leg. 1) with the following composition at different temperatures, the fts value drops significantly with increasing annealing temperature:

a carbon content (C) of 0.12 wt. %, a manganese content (Mn) of 6 wt. %, a silicon content (Si) and/or an aluminum content (Al) as alloy components, with Si wt. %+Al wt. %<1, and the rest of the alloy iron (Fe) and unavoidable impurities.

Similar observations could also be made for alloys 2 and 3 (Leg. 2, Leg. 3 abbreviated).

Moreover, it was shown that the fts value with decreasing carbon content increases significantly. The Leg. 2 has the following composition:

a carbon content (C) of 0.056 wt. %, a manganese content (Mn) of 6 wt. %, a silicon content (Si) and/or an aluminum content (Al) as alloy components, with Si wt. %+Al wt. %<1, and the rest of the alloy iron (Fe) and unavoidable impurities.

The Leg. 3 has the following composition:

a carbon content (C) of 0.0 wt. %, a manganese content (Mn) of 6 wt. %, a silicon content (Si) and/or an aluminum content (Al) as alloy components, with Si wt. %+Al wt. %<1, and the rest of the alloy iron (Fe) and unavoidable impurities.

In other words, such a medium-manganese alloy should not be annealed too high and it should preferably have a low carbon content, if one wants to achieve high fts values. The block arrow designated with −C, which in FIG. 3 is facing upward, is meant to indicate that a reduced carbon content leads to an increased fts value.

The lowering of the annealing temperature leads to a higher chemical enrichment of the austenite, to a smaller grain size, and a more stable residual austenite. Investigations have shown a residual austenite proportion which, in the case of the alloys of the invention, is advantageously in the range ≥10% and ≤60%. These effects lead to increased fts values.

The influence of various annealing methods on the resulting fts values have also been examined. In this context a $1^{st}$ annealing route (GR 1 hereinafter) with an intercritical box annealing method (Method S.2.1 in FIG. 8) and a $2^{nd}$ annealing route (GR 2 hereinafter) with a fully austenitic annealing step (carried out in box or continuous annealing line) followed by an inter-critical box annealing method (method S.1+S.2.2 in FIG. 9), have been examined.

Figure 4:
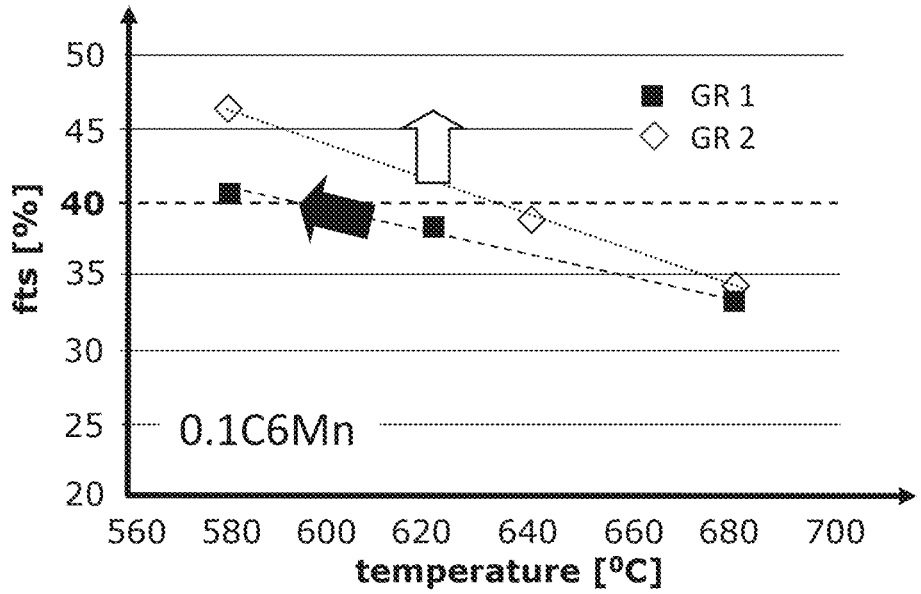
FIG. 4 shows a highly schematic diagram in which the fracture thickness strain (fts) is plotted in percent over the temperature, where the fts values of a medium-manganese-steel alloy of the invention were plotted having been subjected to a $1^{st}$ annealing route (GR 1) with single annealing and a $2^{nd}$ annealing route (GR 2) with a double annealing.

FIG. 4 shows a diagram in which the fts-values of a steel alloy of the invention are plotted against the annealing temperature, where the influence of the $1^{st}$ annealing route was compared to the influence of the $2^{nd}$ annealing route. Specifically, steel alloy samples according to the invention were examined here which comprise a carbon content (C) of 0.1 wt. % and a manganese content (Mn) of wt. 6%, a silicon content (Si) and/or an aluminum content (Al) as alloy components, with Si wt. %+Al wt. %<1, whereby the remainder of the alloy comprises iron (Fe) and unavoidable impurities in the respective melt.

Those alloy samples which have been subjected to the 1st annealing route GR 1 with only one intercritical box annealing (Method S.2.1 in FIG. 8), are in FIG. 4 shown by black squares. Here it shows, as already discussed in connection with FIG. 3, that a reduction in the annealing temperature leads to an increase in the fts values if the alloy samples have a carbon content that is less than 0.12 wt. %. In FIG. 4 this effect is shown by a black block arrow.

The alloy samples which have been subjected to the $2^{nd}$ annealing route GR 2 with a fully austenitic annealing followed by an intercritical box annealing method (Method S.1+S.2.2 in FIG. 9) are shown in FIG. 4 by white filled diamonds. If, for example, a first alloy sample is subjected to the 1st annealing route GR 1 and a second, identical second alloy sample is subjected to the $2^{nd}$ annealing route GR 2, then the second alloy sample shows a fts-value which is higher than the fts value of the first alloy sample. In FIG. 4 this effect is shown by a white block arrow.

If a double annealing GR 2 with a fully austenitic annealing step (S.1 method in FIG. 9), followed by an intercritical box annealing method (Method S.2.2 in FIG. 9), is carried out, this leads to an optimization of the microstructure. Specifically, it has been shown that the ferrite strength increases and that the stability of the retained austenite is increased.

Further investigations of these alloy samples have shown that in comparison of a first alloy sample, which did pass through the 1st annealing route GR 1, and an identical second alloy sample, which did pass through the 2nd annealing route GR 2, the $2^{nd}$ annealing route GR 2 also results in an increase in the uniform elongation UE. I.e., the choice of the annealing route and the parameters (holding temperatures H1 or H2, holding period Δ1 or Δ2, etc.) of the respective annealing routes not only have an influence on the fts-value but also an impact on the UE Value.

Figure 1:
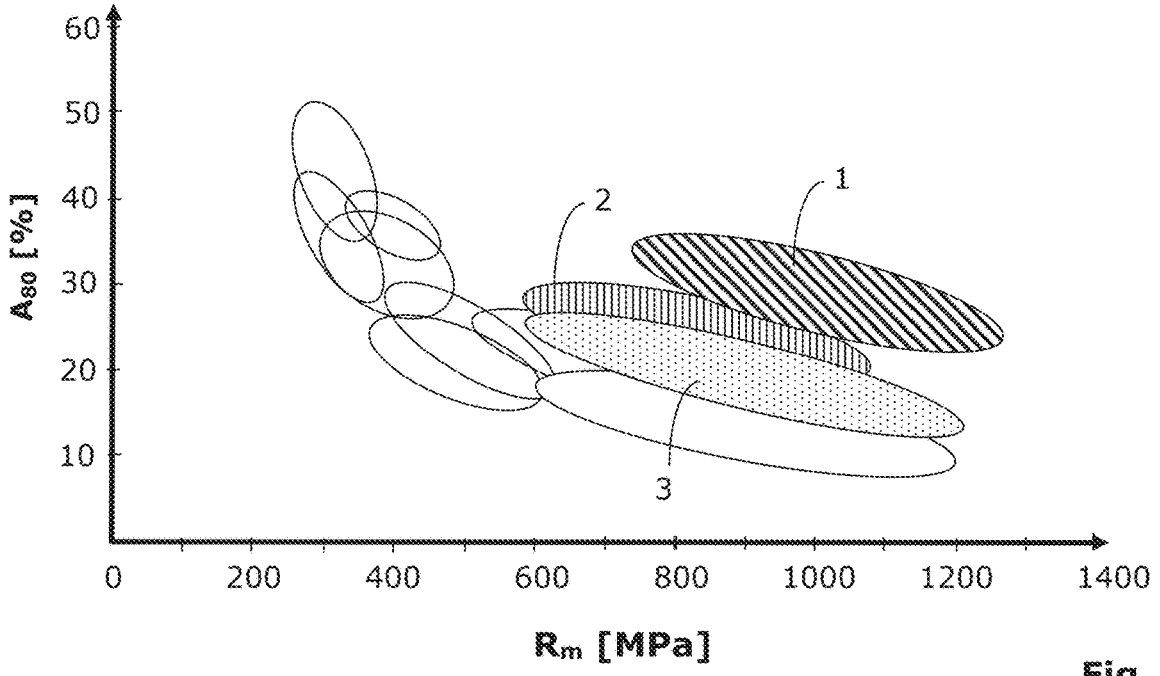
FIG. 1 shows a highly schematic diagram in which the elongation after fracture $A_{80}$ is plotted in percent over the tensile strength $R_m$ in MPa for various steels (prior art)
Figure 2:
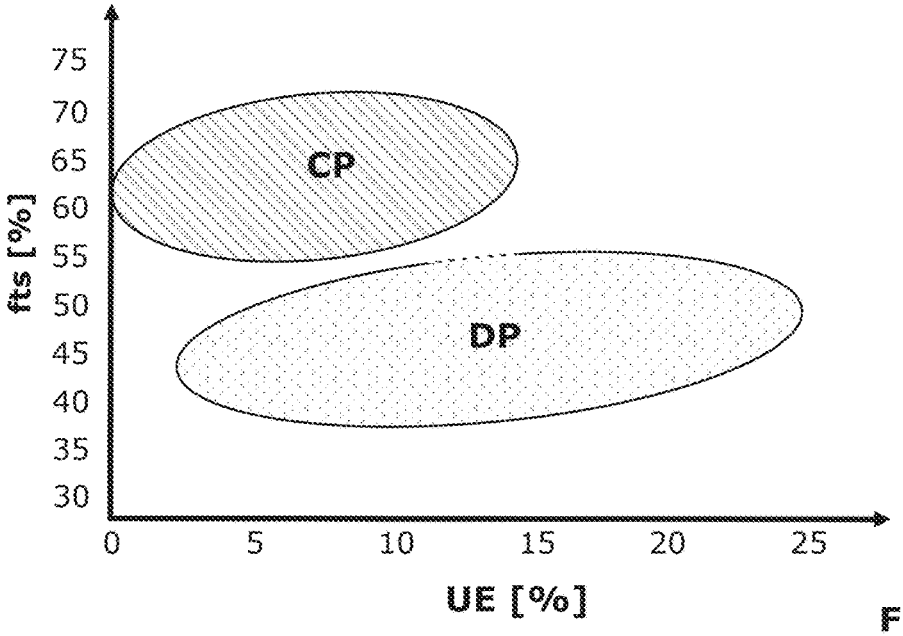
FIG. 2 shows a highly schematic diagram in which the fracture thickness strain (FTS) in percentage over the uniform elongation (UE) in percent for DP steels and CP steels is plotted (prior art)
Figure 5A:
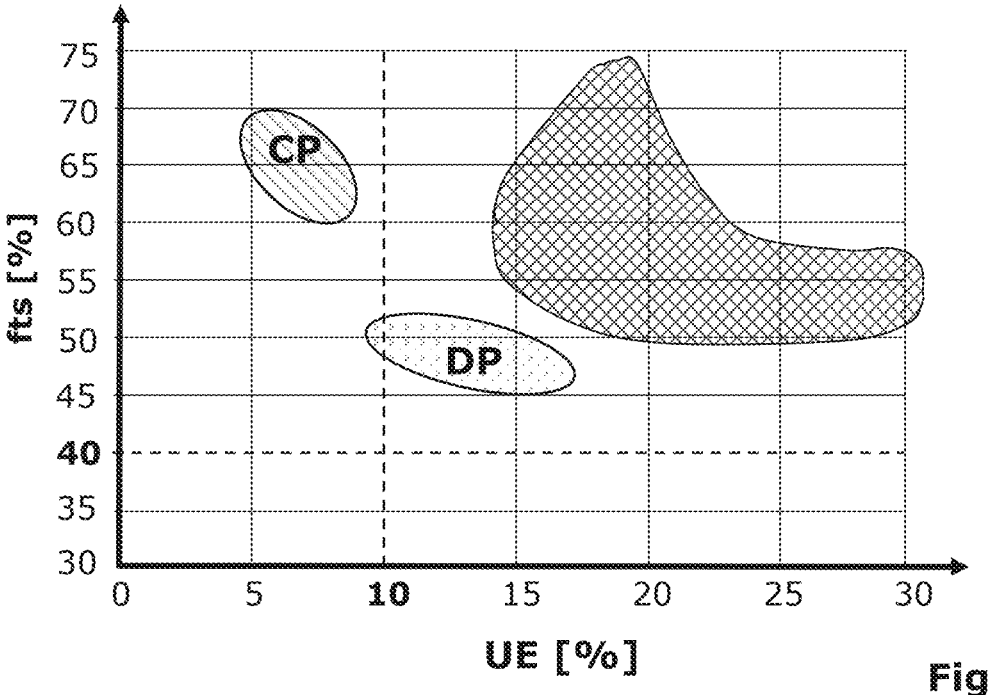
FIG. 5A shows a highly schematic diagram in which the fracture thickness strain (fts) in percent is plotted over the uniform elongation (UE) in percent for DP steels, CP steels and for medium manganese steel alloy of the invention, which was subjected to the $1^{st}$ annealing route (GR 1)

FIG. 5A shows a graph in which the fts-values of various steel alloys of the invention versus the uniform elongation (UE) are plotted. This concerns steel alloys of the invention that were subjected to the $1^{st}$ annealing route GR 1. Similarly to the diagram of FIG. 2, here steel alloys are shown too which either belong to the CP-steels or to the DP steels. In this diagram, the steel alloys of the invention lie in an area which is cross-hatched. Based on this highly schematic representation, it can be seen that the steel alloys of the invention achieve significantly higher UE values compared to the CP steels. In comparison to the DP steels, however, they achieve significantly higher fts values.

Alloy samples with the following compositions have been prepared here and have been subjected to the $1^{st}$ annealing route GR 1 (see Table 1). For these alloys, tensile strengths $R_m$ in the range between 663 MPa and 873 MPa could be achieved. The fts values of this alloy samples did range from about 48% to 74% and the UE-values did range from about 14% to 32%.

TABLE 1

| Alloy No. | C. | Mn | Al | Si | Ti | Fe |
|---|---|---|---|---|---|---|
| 1.1 | 0.1 | 6 | 1 | 0 | | rest |
| 1.2 | 0.056 | 6 | | | | rest |
| 1.3 | 0.003 | 6 | | | | rest |
| 1.4 | 0.003 | 8 | | | 0.11 | rest |
| 1.5 | 0.003 | 10 | | | 0.10 | rest |

Figure 5B:
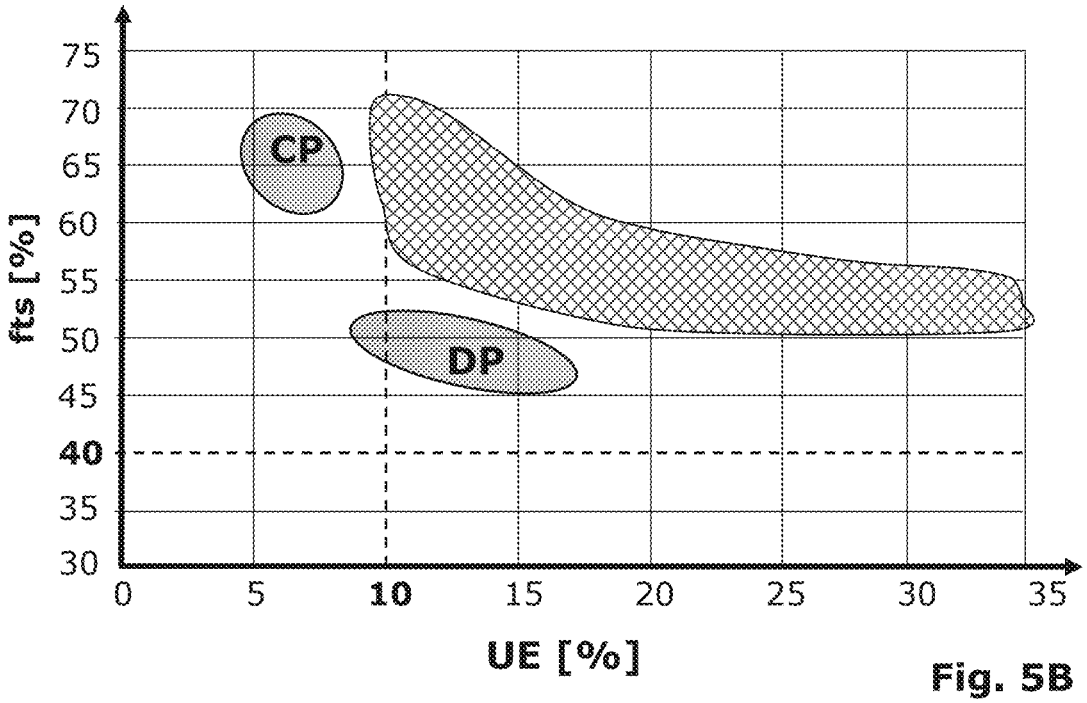
FIG. 5B shows a highly schematic diagram in which the fracture thickness strain (fts) in percent was plotted against the uniform elongation (UE) in percent for DP steels, CP steels and for medium manganese steel alloy of the invention, which was subjected to the $2^{nd}$ annealing route (GR 2)

FIG. 5B shows a further graph in which the fts-values of various steel alloys of the invention are plotted versus the uniform elongation (UE). However, this is a steel alloy of the invention that was subjected to the $2^{nd}$ annealing route GR 2. In this diagram, the steel alloys of the invention lie in an area which is cross-hatched. It can also be seen here that the steel alloys of the invention achieve significantly higher UE values compared to the CP steels. In comparison to the DP steels, however, they achieve significantly higher fts values.

Alloy samples have been prepared here with the following compositions and have been subjected to the $2^{nd}$ annealing route GR 2 (see Table 2). For these alloys, tensile strengths $R_m$ in the range between 597 MPa and 996 MPa could be achieved. The fts values of these alloy specimens were in the range from about 51% to 75%, and the UE-values ranging from about 10% to 36%.

TABLE 2

| Alloy No. | C. | Mn | Al | Si | Ti | Fe |
|---|---|---|---|---|---|---|
| 2.1 | 0.1 | 6 | 1 | 0 | | rest |
| 2.2 | 0.12 | 6 | | | | rest |
| 2.3 | 0.056 | 6 | | | | rest |
| 2.4 | 0.003 | 6 | | | | rest |
| 2.5 | 0.003 | 10 | | | 0.10 | rest |

Table 3 provides the mechanical characteristic values as result of different temperature treatments. Tensile strengths in the range of 820 MPa and 875 MPa and uniform elongations in the range of 27% and 31% been achieved for the respective temperature treatments. The fts values achieved prove to be advantageous. A fully austenitic annealing S.1 as part of a 2-stage annealing procedure GR 2, according to FIG. 9, is preferred, in which a relatively long holding time of 1000 minutes≤H1≤6000 minutes is set. After this fully austenitic annealing follows an intercritical annealing S.2.2, as shown in FIG. 9.

TABLE 3

| | $R_m$ | UE | fts |
|---|---|---|---|
| Intercritical annealing (S.2.1) | 875 | 27 | + |
| Fully austenitic annealing (S.1) 10 seconds ≤ H1 ≤ 1000 minutes + intercritical annealing (S.2.2) | 860 | 31 | ++ |
| Fully austenitic annealing (S.1) 1000 minutes ≤ H1 ≤ 6000 minutes + intercritical annealing (S.2.2) | 820 | 29 | +++ |

In summary, the following can be postulated for the examined alloy compositions of the invention:

the following characteristic values can be achieved with the inventive alloy compositions, if the annealing is carried out according to the process requirements of the invention;

Medium-manganese cold strip steel intermediate products can be produced which have fts values above 40%;

in particular medium-manganese cold strip steel intermediate products can be produced by means of a single annealing GR 1 (see FIG. 8) having fts values in the following range: 48%≤fts≤74% (see FIG. 5A);

in particular medium-manganese cold strip steel intermediate products can be produced by means of a double annealing GR 2 (see FIG. 9) having fts values in the following range: 51%≤fts≤75% (see FIG. 5B);

Medium manganese cold strip steel intermediate products can be produced which have UE values above 10%;

in particular, medium manganese cold strip steel intermediate products can be produced which have UE values in the following range: 14%≤UE≤32% (see FIG. 5A);

in particular, medium manganese cold strip steel intermediate products can be produced which have UE values in the following range: 10%≤UE≤36% (see FIG. 5A). Here UE=10% was defined as a minimum requirement.

In summary, for the investigated alloy compositions of the invention, the following can be postulated:

by reducing the carbon content of a medium-manganese alloy, the fts value can be increased;

by reducing the intercritical annealing temperature T2, which is used for the annealing S.2.1 or S.2.2 of such a medium-manganese alloy, the fts-value can be increased;

the fts value can be increased by choosing the annealing route (annealing route GR 1 or GR 2);

the steel intermediate product can be further optimized by a suitable reduction of the silicon and aluminum alloy components;

the steel intermediate product can be further optimized by an optional reduction in the sulfur content.

These postulates that were previously summarized in a simplified and purely schematic form, give the developer a number of degrees of freedom in the definition of alloys at hand. This will be illustrated by the following example.

When employing the double annealing (GR 2) one can work with alloys whose carbon content per se is somewhat higher than in the simple annealing GR 1, since with the double annealing (GR 2) higher fts values are achieved than with the simple annealing (GR 1).

In FIG. 6, the various effects that were observed on the basis of the inventive alloy compositions are shown in a diagram. This diagram shows the annealing temperature on the ordinate and the carbon content of the alloy composition on the abscissa. The experimentally determined maximum annealing temperatures $T_{ANmax}$ in achieving the improved fts value as a function of carbon content are entered.

The dotted line connecting the white diamonds represents the experimentally determined annealing temperatures $T_{ANMax}$ is for alloys which were subjected a double annealing method (GR 2) were. The dashed line connecting the black squares represents the experimentally determined annealing temperatures $T_{ANmax}$ for alloys that were subjected to a single annealing process (GR 1). The solid line connecting the white circles shows the experimentally determined annealing temperatures $T_{RAmax}$ when the maximum amount of retained austenite is reached as a function of the carbon content.

Alloy compositions which comprise 6 wt. % content of manganese (Mn) have been investigated here. The carbon content has been varied, as indicated on the abscissa, from 0 wt. % to 0.12 wt. %.

The dotted line in FIG. 6 can be expressed by the following equation (1), wherein $T_{ANmax}$ is the maximum annealing temperature. Equation (1) defines the maximum annealing temperature T2 for the intercritical annealing S.2.2 of FIG. 9.

$$T_{ANmax}=684° \text{ C.}-(517° \text{ C.}*\text{C }\%) \quad (1).$$

The dashed line in FIG. 6 can be described by the following equation (2). Equation (2) defines the maximum annealing temperature T2 for the intercritical annealing S.2.1 of FIG. 8.

$$T_{ANmax}=648° \text{ C.}-(352° \text{ C.}*\text{C }\%) \quad (2)$$

It was confirmed by the investigations, the results of which are summarized in FIG. 6, that one can work at low carbon contents with relatively high annealing temperatures to achieve improved fts values. At higher carbon contents the annealing temperature T2 has to be reduced to achieve the improved fts values.

From the results summarized in FIG. 6 it can also be deduced that the reduction of the carbon content to levels close to 0 wt. % is so effective that during annealing of such alloy compositions one can go with the annealing temperature T2 even beyond the temperature $T_{RAmax}$ without thereby reducing the fts value. That is, the reduction of the carbon content is a single measure in the alloys of the invention which is particularly effective.

It can also be deduced from the results summarized in FIG. 6 that at higher carbon contents, which for example are in the range between 0.05 wt. % and 0.12 wt. %, one can achieve higher fts values by reducing the annealing temperature T2. The higher the carbon content of the alloy according to the invention, the greater the reduction in the annealing temperature T2 has to be.

If one anneals twice, as shown in FIG. 9, then the annealing temperature T2 needs only to be lowered with respect to $T_{RAmax}$ at carbon contents of over 0.056 wt. %.

In FIG. 7, further aspects of the invention are shown in a diagram. On the abscissa, the strength classes $R_m$ in MPa and on the ordinate the fts values in percent are plotted. The minimum fts values are shown by an inclined, dashed line, where, as a boundary condition, a UE value is assumed that is at least 10%, i.e. UE 10%. This dashed line can be mathematically described by the equation (3).

$$fts_{min}=104*e^{(-0.001*Rm)} \quad (3).$$

In FIG. 7, the range, defined by a rectangle that is referred to by the reference number 4, is shown which comprises the alloys of the invention. For alloys that are within the range 4, it is ensured that they have a good local deformability on the one hand and a good global deformability on the other hand. The UE values are always above 10% and the fts values are always above 40%.

In Table 4 some characteristic properties of the alloys of the invention are summarized.

TABLE 4

| characteristic properties | | |
|---|---|---|
| fts [%] | 40 | approx. 85 |
| Rm [MPa] | 980 | approx. 590 |
| UE [%] | >10 | |

Some alloy compositions and their characteristic properties are summarized in Table 5. These alloy compositions combined with an annealing temperature chosen according to the invention are shown on purpose in Table 5 because they lie outside the range 4, which has been claimed by the invention.

TABLE 5

| Alloy No. | C. Wt. % | Mn Wt. % | Al Wt. % | Si Wt. % | Cr Wt. % | $T_{AN}$ ° C. | UE % | fts % | TS MPa |
|---|---|---|---|---|---|---|---|---|---|
| 3.1 | 0.18 | 6 | 2 | | | 660 | 8.1 | 34 | 965 |
| 3.2 | 0.10 | 6 | 0.96 | | 1 | 680 | 16 | 29 | 928 |
| 3.3 | 0.084 | 1.83 | 0 | 0.23 | 0.26 | | 13 | 47 | 592 |

The sample no. 3.1 only reaches a UE-value which is 8.1%. These 8.1% are smaller than the minimum UE value of 10%. One of the reasons for not reaching the minimum UE value is the carbon content, which at 0.18 wt. % is above the upper limit of 0.12 wt. % set here. Furthermore, the minimum requirement for the fts value of 40% according to formula 3 is not reached.

Although the sample no. 3.2 achieves a sufficiently high UE-value, the fts value at 29% is significantly below $fts_{min}$=40%. From equation (2) an annealing temperature T2 is calculated, which in accordance with the invention for this particular alloy should be at 612.8° C. max. The sample no. 3.2, however, was annealed at relatively high 680° C., which results in an fts-value being too low.

Although the sample no. 3.3 achieved a sufficiently high UE-value, the fts value at 47% is well below the required fts value of 57% pursuant to formula 3. One of the reasons for the failure to reach the minimum fts value lies in the content of manganese which, at 1.83 wt. %, is below the lower limit of 3.5 wt. % set here.

According to the invention, the alloy is thus composed of the following ingredients:

- a carbon content (C) in the range 0.003 wt. %≤C≤0.12 wt. %,
- a manganese content (Mn) in the range 3.5 wt. %≤Mn≤12 wt. %,
- a silicon content (Si) and/or an aluminum content (Al) as alloy components, with Si wt. %+Al wt. %<1, optionally further alloy components,
- optional micro-alloy components, in particular a titanium content (Ti) and/or a niobium content (Nb) and/or a vanadium content (V), and
- the remainder of the alloy comprising iron (Fe) and unavoidable impurities in a melt.

In at least some of the embodiments the carbon content (C) lies in the range 0.003 wt. %≤C≤0.08 wt. %, and/or the manganese content (Mn) in the range 4 wt. %≤Mn≤10 wt. %, in particular in the range 6 wt. %≤Mn≤10 wt. %, since particularly high fts values can be achieved in this case.

In at least some of the embodiments the silicon content (Si) lies in the range 0 wt. %≤Si≤1 wt. %. In particular, the silicon content (Si) is in the range 0.2 wt. %≤Si≤0.9 wt. %.

In at least some of the embodiments the aluminum content (Al) lies in the range 0 wt. %≤Al≤1 wt. %. In particular, the aluminum content (Al) is in the range 0.01 wt. %≤Al≤0.7 wt. %.

In at least some of the embodiments the alloy comprises a sulfur content (S) in wt. %, which is less than 60 ppm.

In at least some of the embodiments the alloy comprises a chromium content (Cr) in the range of 0 wt. % Cr 1 wt. %.

In at least some of the embodiments the alloy comprises one or more than one of the following micro-alloy components:

- titanium content (Ti),
- niobium content (Nb),
- Vanadium content (V).

In at least some of the embodiments the titanium content (Ti), if present, lies in the range 0 wt. %<Ti≤0.12 wt. %.

In at least some of the embodiments the micro-alloy components together have maximum a proportion of 0.15 wt. % of the alloy.

The information made here regarding the composition of the alloy are understood to be in weight percent. The rest of the alloy includes iron (Fe) as well as impurities that cannot be avoided in such a melt. The data in percent by weight always add up to 100 wt. %.

As already described, the method of the invention comprises a special annealing step which is executed after cold rolling step:

Performing an inter-critical box annealing S.2.1 or S.2.2 with a maximum annealing temperature T2 of 684° C.–(517° C.*to the carbon content in wt. %). The carbon content in wt. % is also referred to here as C %. If this intercritical box annealing method is part of a one-step annealing process, then the maximum annealing temperature T2 can even be below these values, as expressed by the formula 648° C.–(352° C.*the carbon content in terms of wt. %).

Exemplary details of a one-step annealing process GR 1 are shown in FIG. 8. In the intercritical box annealing process S.2.1, the alloy is heated to a holding temperature T2. In FIG. 8, the heating is denoted by E2. Then the alloy is held for a holding period Δ2 at the holding temperature T2. Subsequently the cooling occurs. In FIG. 8, the cooling is designated by Ab2. In the following table 6 exemplary parameters for a one-step annealing process GR 1 of the invention are given:

TABLE 6

| E2 | T2 | Δ2 | Ab2 |
|---|---|---|---|
| 100 minutes < E2 < 1500 minutes | 648° C. – (352° C. * the carbon content in wt. %) | 1000 minutes < Δ2 < 6000 minutes | 100 minutes < Ab2 < 2500 minutes |

The intercritical box annealing, which is also abbreviated to intercritical annealing, is performed with a holding temperature T2 in the α+γ-two-phase region. The area between $Ac_3$ and $Ac_1$. (see FIGS. 8 and 9) is referred to as the α+γ-two-phase region.

The fully austenitic annealing method S.1 (see FIG. 9) is performed with a holding temperature T1 above the $Ac_3$-temperature in the single-phase γ-region, i.e. $1>Ac_3$.

Exemplary details of a two-step annealing process GR 2 are shown in FIG. 9. In the fully austenitic annealing process S.1, the alloy is heated to a holding temperature T1. In FIG. 9, the heating is denoted by E1. The alloy is then held at the holding temperature T1 for a holding period Δ1. This is followed by the cooling. In FIG. 9, the cooling is designated by Ab1. In the subsequent intercritical hood annealing process S.2.2, the alloy is heated to a holding temperature T2. In FIG. 9, the heating is denoted by E2. Then the alloy is held at the holding temperature T2 for a holding period Δ2. This is followed by cooling. In FIG. 9, the cooling is designated by Ab2. In the following Table 7 exemplary parameters of a two-stage annealing process GR 2 of the invention are given:

TABLE 7

| E1 | T1 | Δ1 | Ab1 |
|---|---|---|---|
| 30 seconds < E1 < 1500 minutes | T1 > $A_{c3}$ | 10 seconds < Δ1 < 6000 minutes | 30 seconds < Ab1 < 2500 minutes |
| E2 | T2 | Δ2 | Ab2 |
| 100 minutes < E2 < 1500 minutes | 684° C. − (517° C. * the carbon content in wt. %) | 1000 minutes < Δ2 < 6000 minutes | 100 minutes < Ab2 < 2500 minutes |

As can be derived from the different diagrams and the description of these diagrams, it is important for achieving high fts-values, which are above 40%, that the annealing temperature T2 for the intercritical box annealing process is not too high. The maximum annealing temperature T2, which is used for intercritical box annealing processes, is always lower than $Ac_3$ and its upper limit is limited by equations (1) or (2).

The properties of cold strip steel intermediate products of the invention are, inter alia, influenced by the selection of the annealing temperature T1 and/or T2, wherein especially the temperature T2 is dependent on the carbon content in wt. %, and is always less than the maximum annealing temperature $Ac_3$.

Fts-values result for the cold strip steel intermediate products of the invention, which according to equation (3) amount to at least $104*e^{(-0.001*Rm)}$ at a minimum uniform elongation ($A_g$) of 10% and a tensile strength ($R_m$) in the range from 590 MPa to 1350 MPa. These fts values were determined on non-notched flat tensile specimens of the cold strip steel intermediate products.

The cold strip steel intermediate product of the invention is characterized inter alia in that it has a microstructure with the following proportions, if a single-step annealing process GR 1 of FIG. 8 is used:

a residual austenite content in the range ≥10% and 60%,
an alpha ferrite content in the range ≥20% and ≤90%, and
a cementite content ($(Fe, Mn)_3C$) in the range ≥0% and ≤5%.

The cold strip steel intermediate product of the invention is characterized inter alia in that it has a microstructure with the following proportions, if a two-step annealing process GR 2 of FIG. 9 is used:

a martensite content in the range ≥0% and ≤20%,
a residual austenite content in the range ≥10% and ≤60%,
an alpha ferrite content in the range ≥20% and ≤90%, and
a cementite content ($(Fe, Mn)_3C$) in the range ≥0% and ≤5%.

This microstructure with a martensite content, a retained austenite content, an alpha-ferrite content and a cementite content provides for the special properties of the cold strip steel intermediate products of the invention.

REFERENCE AND FORMULA SYMBOLS

| | |
|---|---|
| Reqion of the medium manganese steels | 1 |
| Region of the TRIP steels | 2 |
| Region of the TBF and Q&P steels | 3 |
| region | 4 |
| austenitic phase | γ |
| two-phase area | α + γ |
| elongation after fracture in % | A |
| Cooling during austenitic annealing | Ab1 |
| Cooling during intercritical annealing | Ab2 |
| Temperature at the beginning of austenite formation/austenite start temperature in ° C. | $A_{c1}$ |
| Temperature at the end of austenite formation/austenite end temperature in ° C. | $A_{c3}$ |
| uniform elongation in % | $A_g$ |
| elongation after fracture with measuring length 80 mm in % | $A_{80}$ |
| Carbon content in percent by weight | C % |
| Heating during austenitic annealing | E1 |
| Heating during intercritical annealing | E2 |
| Initial thickness of the intermediate steel product | $d_0$ |
| Thickness at the fracture surface of the intermediate steel product | $d_1$ |
| Duration of holding during the fully austenitic annealing | Δ1 |
| Duration of holding during the intercritical annealing | Δ2 |
| fracture thickness strain in % | fts |
| Minimum value of the fracture thickness strain in % | $fts_{min}$ |
| ferritic phase | α |
| Annealing route | GR |
| Holding during fully austenitic annealing | H1 |
| Holding during intercritical annealing | H2 |
| Tensile strength in MPa | $R_m$ |
| fully austenitic annealing | S.1 |
| Intercritical annealing | S.2.1, S.2.2 |
| time | t |
| Holding temperature during fully austenitic annealing | T1 |
| Holding temperature during intercritical annealing | T2 |
| maximum annealing temperature in ° C. | $T_{ANmax}$ |
| Annealing temperature when the maximum amount of retained austenite is reached in ° C. | $T_{RAmax}$ |
| Uniform elongation in % | UE |

The invention claimed is:

1. A method for providing a medium-manganese cold strip steel intermediate product, having a fracture thickness strain (fts) value after annealing which is at least 40%, wherein the fts value is calculated with $(d_0-d_1)/d_0*100$ in %, wherein $d_0$ is an initial thickness of a non-notched flat tensile sample of a steel intermediate product after annealing and wherein $d_1$ is a thickness at a fracture surface thereof, comprising:

providing a cold strip steel intermediate product having an alloy comprising:

a carbon content (C) in the range of 0.003 wt. %≤C≤0.12 wt. %, a manganese content (Mn) in the range of 3.5 wt. %≤Mn≤12 wt. %, a silicon content (Si) and/or an aluminum content (Al) as alloy contents, with Si wt. %+Al wt. %<1, and wherein the rest of the alloy comprises iron (Fe) and unavoidable impurities in a melt, defining a maximum annealing temperature which is dependent on the carbon content in wt. % of the provided steel intermediate product and is defined by the equation 648° C.−(352° C.*the carbon content in wt. %), performing only a single annealing step as an intercritical box annealing, the intercritical box annealing performed as a single-step annealing process (GR1) with an annealing temperature which is lower than the maximum annealing temperature.

2. The method according to claim 1, characterized in that the intercritical box annealing has a heating step (E2), a holding phase (H2) with a holding period (Δ2) and a cooling process (Ab2), whereby the holding period (Δ2) lasts more than 1000 and less than 6000 minutes.

3. The method according to claim 1, characterized in that the cold strip steel intermediate product shows an fts value, which is at least $104*e^{(-0.001*Rm)}$ at a minimum uniform elongation ($A_g$) of 10% and with a tensile strength ($R_m$) in the range of 590 MPa to 1350 MPa.

4. The method according to claim 1, characterized in that the carbon content (C) is in the range of 0.003 wt. %≤C≤0.08 wt. %.

5. The method according to claim 1, characterized in that the manganese content (Mn) lies in the range of 4 wt. %≤Mn≤10 wt. %.

6. The method according to claim 1, characterized in that the alloy comprises a silicon content (Si) in the range of 0 wt. %≤Si<1 wt. %.

7. The method according to claim 1, characterized in that the alloy comprises an aluminum content (Al) in the range of 0 wt. %≤Al<1 wt. %.

8. The method according to claim 1, characterized in that the alloy comprises a chromium content (Cr) in the range of 0 wt. %≤Cr≤1 wt. %.

9. The method according to claim 1, characterized in that the alloy comprises a sulfur content(S) which is less than 60 ppm.

* * * * *